US006155900A

United States Patent [19]

Hofmann et al.

[11] Patent Number: 6,155,900

[45] Date of Patent: Dec. 5, 2000

[54] FIBER SPACERS IN LARGE AREA VACUUM DISPLAYS AND METHOD FOR MANUFACTURE

[75] Inventors: James J. Hofmann; Jason B. Elledge, both of Boise, Id.

[73] Assignee: Micron Technology, Inc., Bosie, Id.

[21] Appl. No.: 09/414,862

[22] Filed: Oct. 12, 1999

[51] Int. Cl.[7] ..... H01J 9/24

[52] U.S. Cl. ..... 445/24; 313/495

[58] Field of Search ..... 445/24, 25; 313/495; 65/411, 408, 429, 31, 42

[56] References Cited

U.S. PATENT DOCUMENTS

| | | | |
|---|---|---|---|
| 3,424,909 | 1/1969 | Rougeot . | |
| 3,812,559 | 5/1974 | Spindt et al. | 29/25.18 |
| 3,875,442 | 4/1975 | Wasa et al. | 313/193 |
| 3,979,621 | 9/1976 | Yates . | |
| 3,990,874 | 11/1976 | Schulman . | |
| 4,091,305 | 5/1978 | Poley et al. | 313/220 |
| 4,183,125 | 1/1980 | Meyer et al. | 29/25.15 |
| 4,292,092 | 9/1981 | Hanak | 148/1.5 |
| 4,451,759 | 5/1984 | Heynisch | 313/495 |
| 4,705,205 | 11/1987 | Allen et al. | 228/180.2 |
| 4,749,840 | 6/1988 | Piwczyk | 219/121 |
| 4,874,461 | 10/1989 | Sato et al. | 156/633 |
| 4,892,592 | 1/1990 | Dickson et al. | 136/244 |
| 4,923,421 | 5/1990 | Brodie et al. | 445/24 |
| 4,940,916 | 7/1990 | Borel et al. | 313/306 |
| 4,973,378 | 11/1990 | Lee et al. | 156/633 |
| 5,070,282 | 12/1991 | Epsztein | 315/383 |
| 5,136,764 | 8/1992 | Vasquez | 29/25.01 |
| 5,151,061 | 9/1992 | Sandhu | 445/24 |
| 5,205,770 | 4/1993 | Lowrey et al. | 445/24 |
| 5,209,688 | 5/1993 | Nishigaki et al. | 445/24 |
| 5,229,691 | 7/1993 | Shichao et al. | 315/366 |
| 5,232,549 | 8/1993 | Cathey et al. | 456/633 |
| 5,324,602 | 6/1994 | Inada et al. | 430/23 |
| 5,329,207 | 7/1994 | Cathey et al. | 315/169.1 |
| 5,342,477 | 8/1994 | Cathey | 156/643 |
| 5,342,737 | 8/1994 | Georger, Jr. et al. | 430/324 |
| 5,347,292 | 9/1994 | Ge et al. | 345/74 |
| 5,371,433 | 12/1994 | Home et al. | 313/495 |
| 5,374,868 | 12/1994 | Tjaden et al. | 313/310 |
| 5,391,259 | 2/1995 | Cathey et al. | 156/643 |
| 5,413,513 | 5/1995 | Home et al. | 445/24 |
| 5,445,550 | 8/1995 | Xie et al. | 445/24 |
| 5,448,131 | 9/1995 | Taylor et al. | 313/309 |
| 5,449,131 | 9/1995 | Kumar et al. | 313/309 |
| 5,486,126 | 1/1996 | Cathey et al. | 445/25 |
| 5,561,343 | 10/1996 | Lowe | 445/24 |
| 5,621,272 | 4/1997 | Levine et al. | 313/422 |
| 5,634,585 | 6/1997 | Stansbury | 228/105 |
| 5,648,698 | 7/1997 | Makishima et al. | 313/309 |
| 5,708,325 | 1/1998 | Anderson et al. | 313/495 |
| 5,717,287 | 2/1998 | Amrine et al. | 313/495 |
| 5,795,206 | 8/1998 | Cathey et al. | 445/24 |
| 5,811,927 | 9/1998 | Anderson et al. | 445/24 |
| 5,989,090 | 11/1999 | Perrin et al. | 445/24 |

FOREIGN PATENT DOCUMENTS

| | | |
|---|---|---|
| 0690472 A1 | 3/1996 | European Pat. Off. . |
| 2-165540 | 6/1990 | Japan . |

OTHER PUBLICATIONS

"Phosphors for Full–Color Microtips Fluorescent Displays", Conference Record of the 1991 International Display Research Conference, F. Levy and R. Meyer, p. 20–23.

"Influence of Various Gases on the Emission of Field Emitter Arrays", Futaba Corporation, S. Itoh T. Niiyama and M. Yokoyama, 2 pages.

"Fabrication and Emission Characteristics of Polycrystalline Silicon Field Emitters", Jpn. J. Appl. Phys. vol. 34 (1995), Hashiguchi, Mimur and Hiroyuki, p. L883–L885.

*Primary Examiner*—Kenneth J. Ramsey
*Attorney, Agent, or Firm*—Trask Britt

[57] ABSTRACT

A process for fabricating high-aspect ratio support structures comprising: creating a rectangular fiber bundle by stacking selectively etchable glass strands having rectangular cross-sections; slicing the fiber bundle into rectangular tiles; adhering the tiles to an electrode plate of an evacuated display; and selectively removing glass strands, thereby creating support structures.

32 Claims, 7 Drawing Sheets

FIBER SPACERS IN LARGE AREA VACUUM DISPLAYS AND METHOD FOR MANUFACTURE

GOVERNMENTAL RIGHTS

This invention was made with Government support under Contract No. DABT63-93-C-0025 awarded by Advanced Research Projects Agency (ARPA). The Government has certain rights in this invention.

FIELD OF THE INVENTION

This invention relates to flat panel display devices, and more particularly to processes for creating fiber spacer structures which provide support against the atmospheric pressure on the flat panel display without impairing the resolution of the image.

BACKGROUND OF THE INVENTION

In flat panel displays of the field emission type, an evacuated cavity is maintained between the cathode electron-emitting surface and its corresponding anode display face. Since there is a relatively high voltage differential between the cathode emitting surface and the display screen, it is important to prevent catastrophic electrical breakdown between them. At the same time, the narrow spacing between the plates is necessary for structural thinness and to obtain high image resolution. Spacer structures incorporated between the display face and the baseplate perform these functions.

In order to be effective, spacer structures must possess certain characteristics. They must have sufficient non-conductivity to prevent catastrophic electrical breakdown between the cathode array and the anode. This is necessary because of both the relatively close inter-electrode spacing (which may be on the order of 200 $\mu$m), and relatively high inter-electrode voltage differential (which may be on the order of 300 or more volts).

Further, the supports must be strong enough to prevent the flat panel display from collapsing under atmospheric pressure. Stability under electron bombardment is also important, since electrons will be generated at each of the pixels. The spacers must also withstand "bake-out" temperatures of around 400° C. used in forming the high vacuum between the faceplate and baseplate of the display.

For optimum screen resolution, the spacer structures must be almost perfectly aligned to array topography. They must be of sufficiently small cross-sectional area so as to be invisible during display operation. Hence, cylindrical spacers must have diameters no greater than about 50 microns. A single cylindrical lead oxide silicate glass column, having a diameter of 25 microns and a height of 200 microns, will have a buckle load of about $2.67\times10^{-2}$ newtons. Buckle loads, of course, will decrease as height is increased with no corresponding increase in diameter.

It is also of note that a cylindrical spacer having a diameter d will have a buckle load that is only about 18% greater than that of a spacer of square cross-section and a diagonal d, although the cylindrical spacer has a cross-sectional area about 57% greater than the spacer of square cross section.

Known methods for spacer fabrication using screen-printing, stencil printing, or glass balls do not provide a spacer having a sufficiently high aspect ratio. The spacers formed by these methods either cannot support the high voltages, or interfere with the display image. Other methods which employ the etching of deposited materials suffer from slow throughput (i.e., time length of fabrication), slow etch rates, and etch mask degradation. The use of lithographically defined photoactive organic compound results in the formation of spacers, which are incompatible with the high vacuum conditions, and elevated temperatures characteristic in the manufacture of field emission displays (FED).

Accordingly, there is a need for a high aspect ratio spacer structure for use in a FED, and an efficient method of manufacturing a FED with such a spacer.

SUMMARY OF THE INVENTION

A process for fabricating high-aspect ratio support structures is provided. The process comprises creating a rectangular fiber bundle of glass strands, wherein contiguous groups of glass strands form a pattern. The pattern can be of a variety of shapes, including a cross, tee, I-beam, rail, or bracket. The fiber bundle is sliced into "tiles" and adhered to an electrode plate of an evacuated display.

The fiber bundle is comprised of groups of selectively etchable glass strands, which may or may not be coated with a resistive material. The glass strands are preferably square in cross-section, and are therefore stackable. The etchable and non-etchable strands are stacked in a desired pattern in the bundle; the bundle is drawn to thereby increase its length and decrease its diameter, while maintaining its shape and pattern. Several bundles are then stacked, and drawn into a fiber boule. The fiber boule is sliced into rectangular tiles. Adhesive is deposited on the electrode plate of the vacuum display to hold the tiles in the desired locations, and the tiles disposed about the display plate. Some of the glass fibers are then selectively removed, thereby creating support structures.

In an alternative embodiment of the present invention, a process for forming spacers useful in large area displays is disclosed. The process comprises forming rectangular bundles comprising fiber strands held together with a binder; slicing the bundles into rectangular slices, adhering the slices onto an electrode plate of the display; and removing the binder. The ends of the glass fibers may be polished, and the binder near the ends of the glass fibers etched back. The binder is then removed, thereby creating spacers.

One advantage of this method of stacking fibers in a pattern and forming boules therefrom is that collimated spacers are made in an accurate, repeatable pattern, not easily attainable when other shapes, such as round fibers are utilized. This reduces the cost of manufacturing the panel, as well as the weight of the panel. The use of such spacers enables the sintering of thin panel glass substrates, while holding off the forces due to atmospheric pressure. This technique will also result in high aspect ratio spacers, so higher resolution can be attained without having the output image adversely affected by the presence of spacers. This technique also increases the chances that the fiber strand is orderly and regularly distributed in the glass boule. The evenly collimated distribution is maintained throughout the spacer forming process, thereby improving the yield in the percentage of fibers adhering onto the glue dots.

BRIEF DESCRIPTION OF THE DRAWINGS

The present invention will be better understood from reading the following description of nonlimitative embodiments, with reference to the attached drawings, wherein below:

FIG. 6A is a spacer support structure comprising columns disposed about the electrode plate, according to the process of the present invention;

FIG. 6B is a spacer support structure comprising a rail support disposed about the electrode plate, according to an alternative embodiment of the process of the present invention; and FIG. 6C is a spacer support structure comprising a cross-rail support structure disposed about the electrode plate, according to another alternative embodiment of the process of the present invention.

DETAILED DESCRIPTION OF THE INVENTION

Figure 1:
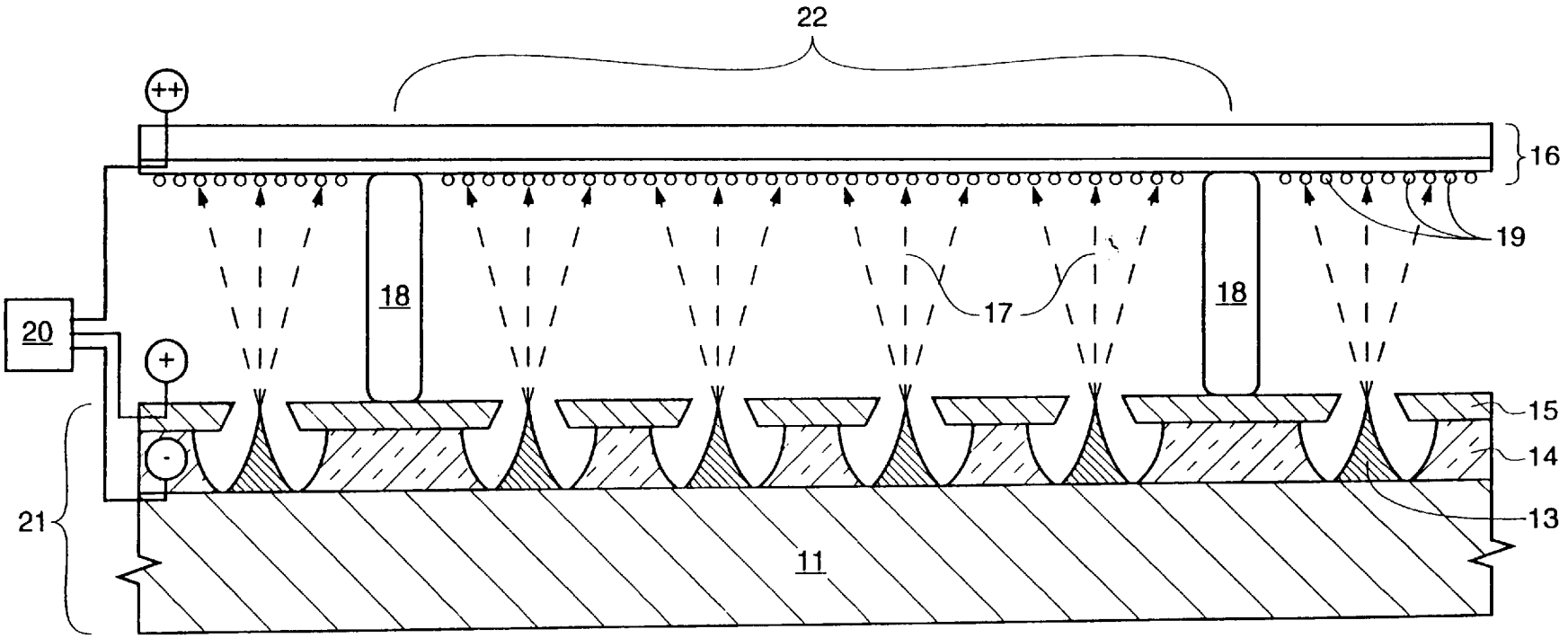
FIG. 1 is a schematic cross-section of a representative pixel of a field emission display comprising a faceplate with a phosphor screen, vacuum sealed to a baseplate which is supported by the spacers formed according to the process of the present invention.

Referring to FIG. 1, a representative field emission display employing a display segment 22 is depicted. Each display segment 22 is capable of displaying a pixel of information. A black matrix 25, or grille, surrounds the segments for improving the display contrast. Gate 15 serves as a grid structure for applying an electrical field potential to its respective cathode 13. When a voltage differential, through source 20, is applied between the cathode 13 and the grid 15, a stream of electrons 17 is emitted toward a phosphor coated screen 16. A dielectric insulating layer 14 is deposited on the conductive cathode 13.

Disposed between faceplate 16 and baseplate 21 are located spacer support structures 18, which function to support the atmospheric pressure that exists between them as a result of the vacuum.

The process of the present invention provides a method for fabricating high aspect ratio support structures to function as spacers 18 through the use of stackable glass fiber strands, which have a rectangular or substantially square cross-section.

Various aspects of using fibers for spacer structures are described in U.S. Pat. No. 5,486,126 entitled, *Spacers for Large Area Displays* and U.S. Pat. No. 5,795,206 entitled, *Fiber Spacers in Large Area Vacuum Displays and Method for Manufacture of Same,* which are commonly owned with the present invention. These patents are hereby incorporated by reference as if set forth in their entirety.

The preferred manufacturing process according to the present invention starts with fibers or strands of a non-etchable glass, such as, but not limited to, potash rubidium lead. The non-etchable glass preferably does not etch in hydrochloric acid and has significant etch resistance to aqueous hydrofluoric acid.

The etchable strands 18 are comprised of glass which has a high lead content, preferably greater than 40%. PbO added to the glass in sufficient amounts will make it soluble in HCl or other acids. The viscosity-temperature curve can be adjusted by varying the other components of the glass, such as, for example, $Na_2O$, $CaO_2$, $Al_2O_3$, and other materials. Since the completed and assembled display is later "baked out," the coefficient of thermal expansion of the glass strands should be close to that of the substrate material 11 which is used for the display face 16 and/or baseplate 21.

The fibers 18 used in the present invention may employ a high resistance coating which allow a very slight bleed off of stray electrons to occur over time. This will prevent a destructive arc over. Highly resistive silicon is one example of a thin coating that is useful on the fibers 18. Such a coating is applied by techniques commonly known in the art, such as chemical vapor deposition (CVD) of an organic-metal material or sputtering or evaporating a thin layer of carbon onto the silicon.

The starting non-etchable glass strand is preferably square or rectangular in cross-section. Commercially available fibers have widths from about 0.18" to 0.25" which are much too large for use as a spacer support. This width is substantially reduced through the process of the present invention, so that the width of the final glass strand 18 is in the range of 0.001" to 0.002".

Figure 2A:
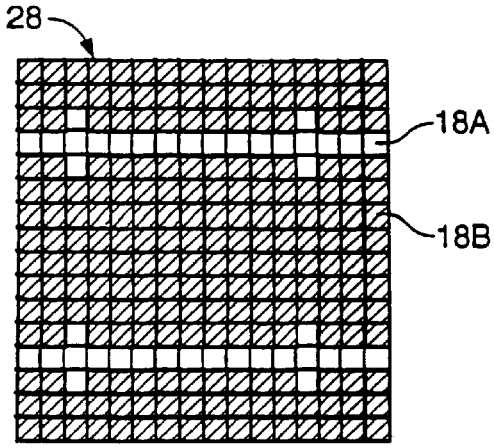
FIG. 2A is a schematic cross-section of a fiber bundle fabricated according to the process of the present invention.

As depicted in FIG. 2A, the non-etchable glass strands 18A are assembled in a pattern with etchable glass strands 18B to thereby form a mixed glass assembly 28 of a generally contiguous group of fibers 18A, 18B. Small gaps will occur if fibers 18A are dislodged from the bundle 28 as a result of the manufacturing process. Since the fibers 18A, 18B are rectangular in shape, they are relatively easy to stack in patterns. The mixed glass assembly 28 will also be rectangular, and preferably, square in cross-section. The shape of the final spacer structure will be comprised of a pattern formed by the cross-sections of a plurality of the contiguous rectangular fibers 18A.

The glass assembly 28 is thermally drawn down to an intermediate size. The result of this drawing step is a single-fiber or unit cell or bundle 28 having a diameter of approximately 0.125". The drawing step is preferably performed in a drawing tower. The single-fiber unit cell 28 formed from the mixed glass assembly 28 has a reduced cross-section and increased length.

Figure 2B:
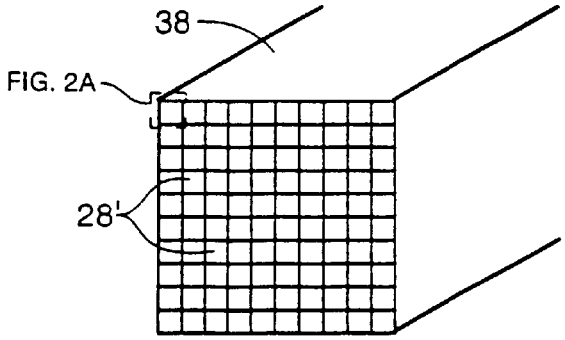
FIG. 2B is a schematic cross-section of a group of fiber bundles of FIG. 2A arranged in a boule, which is drawn to an intermediate size, according to the process of the present invention.

Several steps of glass technology are applied to transform the single-fiber unit cells 28 into a glass boule 38, as will be described herein. Such a boule 38 is comprised of up to 2000 glass fibers. FIG. 2B depicts the square or rectangular arrangement of stacked single-fiber unit cells 28. The single-fiber unit cells 28 are tacked together in an oven (at a temperature above 100° C. below the glass softening temperature) so that the shape is maintained.

Figure 2C:
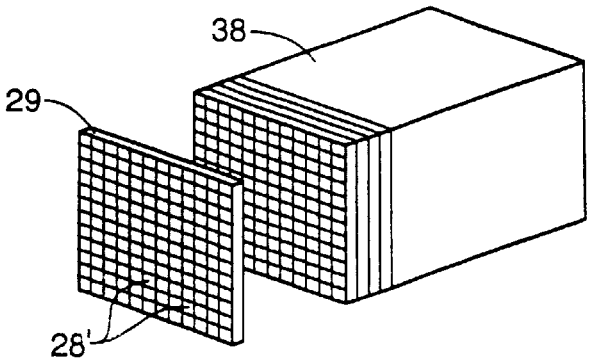
FIG. 2C is a schematic cross-section of the boule of fiber bundles of FIG. 2B, which has been drawn to a smaller size and sliced, according to the process of the present invention.
Figure 3:
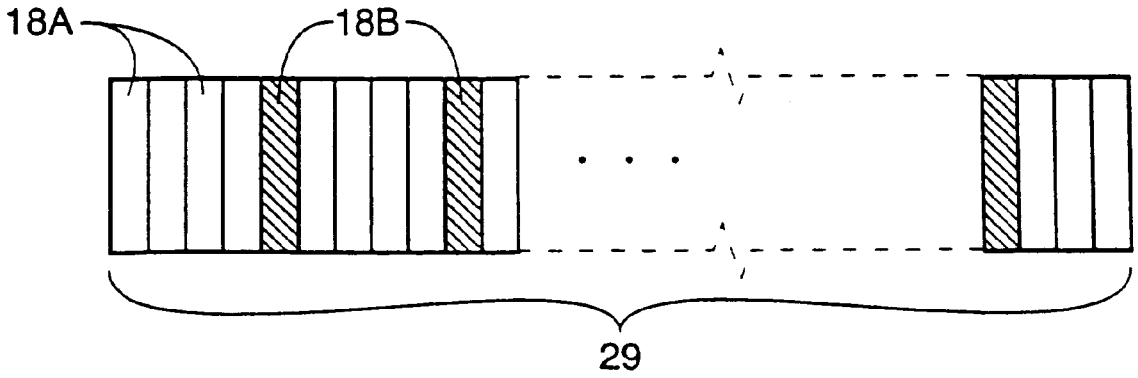
FIG. 3 is a schematic side-view of a slice of the boule of FIG. 2C, fabricated according to the process of the present invention.

As depicted in FIG. 2C, the boule 38 or stack of single-fiber unit cells is redrawn down to the final desired dimension. Each group of contiguous non-etchable fibers 18A is surrounded by a pattern that is selectively etchable with respect to it. The fibers 18 are regularly distributed in a collimated, i.e., parallel and evenly spaced manner within the multi-fiber 28. The outer shape is substantially rectangular, and the cross-sections are rectangular or square.

After drawing, there is an adherence between the glass strands of the single-fiber unit cells 28. This may be sufficient to hold the strands in some cases. However, in other cases, the stability of the boule 38 is further enhanced by placing the drawn boule of fibers in a mold and fusing the strands under pressure, whereby a sintered, solid boule 38 is created. The boule 38 is made in a press exerting mechanical pressure on the outside of the stacked single-fiber unit cells. Appropriate sintering temperature is applied, as well as vacuum of about $10^{-3}$ Torr for removing gas from the interstices between the fibers. Alternatively, a vacuum is not applied during sintering. Acceptable sintering parameters include 300–500° C.±20° C. for several hours (between about 4–12 hours) with adequate time for annealing and cool down (about 6–12 hours for annealing and cool down). The time varies depending on thickness and pressure.

Alternatively, the glass fibers can be coated with a binder material to assist in maintaining them in the desired pattern. A temporary binder may be applied to individual fibers prior to bundling, or to several fibers 18 at a time in a bundle 28 or in close proximity, to provide spacing between fibers 18.

However, in the preferred embodiment, no binder material is employed. Since the glass strands 18 have a rectangular or substantially square cross-section, they are readily stacked in a pattern and formed into bundles 28 and/or boules 38.

FIGS. 2B and 2C depict the boule 38 which is sliced on average at about 0.015" to 0.020" with a wafer saw. Depending on how well the previous steps were carried out, there may be some unevenness in height among the strands. Hence, planarizing may be done at this point. Chemical-mechanical planarization can be used to even out the fibers. This step also polishes the fiber ends flat and parallel.

Figure 4:
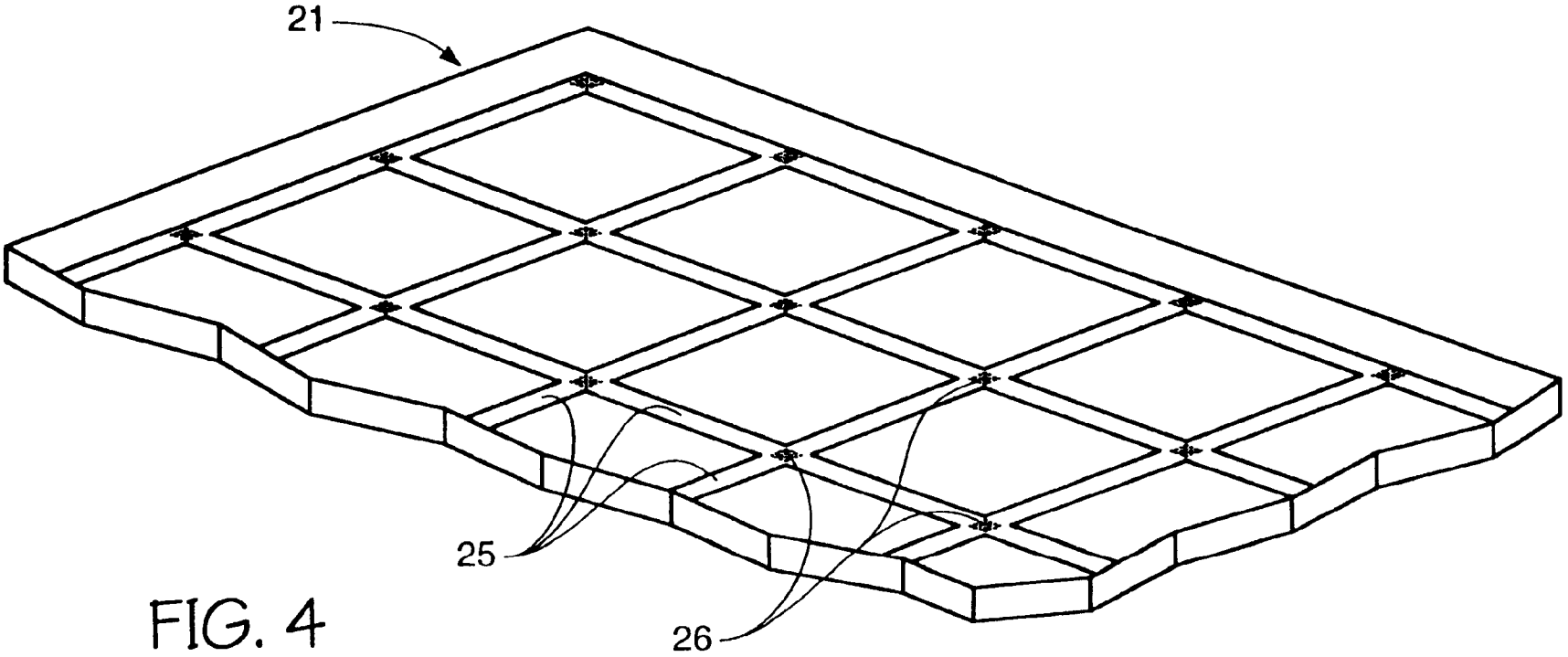
FIG. 4 is a schematic cross-section of the electrode plate of a flat panel display without the slices of FIG. 3 disposed thereon.

Once the slices or tiles 29 of fibers have been created, they are attached to one of the electrode plates 16, 21 of the evacuated display. Referring now to FIG. 4, dots of adhesive 26 are provided at the sites where the spacers 18 are to be located. Some examples of adhesives include, but are not limited to potassium silicates and sodium silicates, which are alkaline solutions that bond glass really well when dried. Alternatively epoxies can be used, as well as any other adhesion material known in the art.

One acceptable location for adhesion dots 26 is in the black matrix region 25. The black matrix region 25 is the region where there is no emitter 13 or phosphor dot. In these sites 25, the support pillars 18 do not distort the display image.

Figure 5:
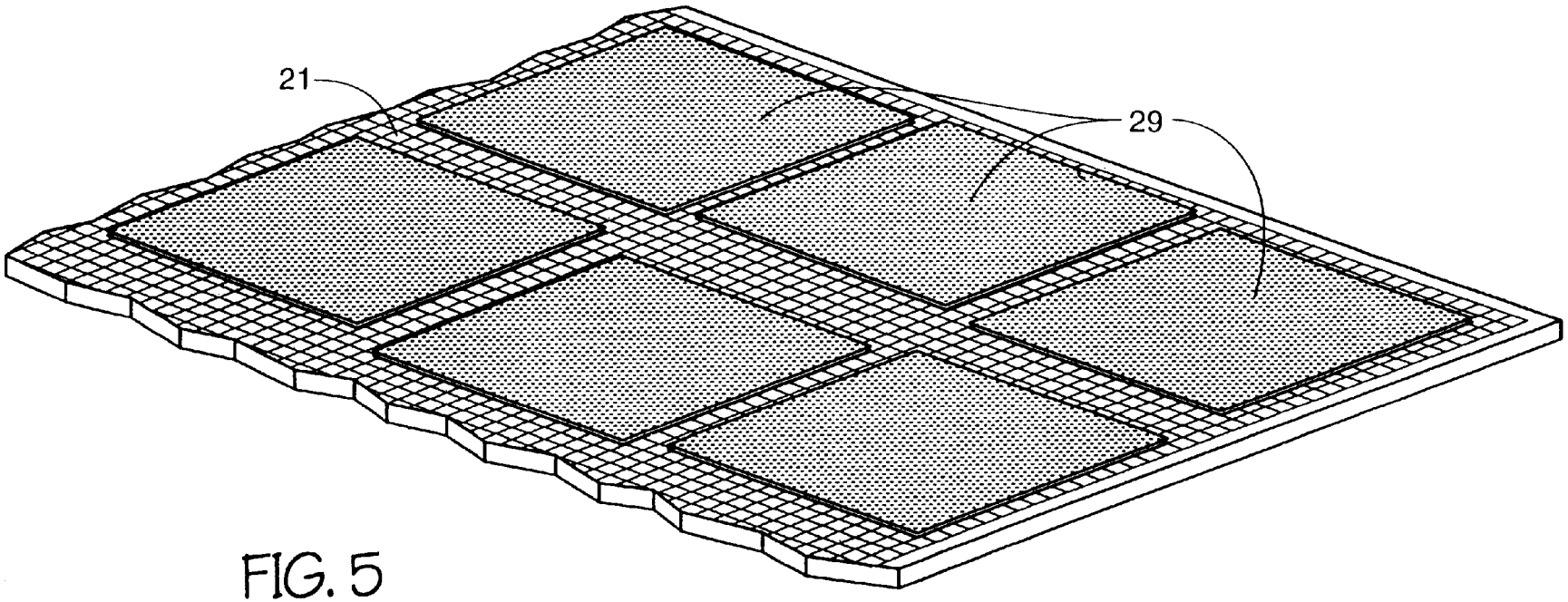
FIG. 5 is a schematic cross-section of an electrode plate of a flat panel display with the slices of FIG. 3 disposed thereon.

In the illustrative example, the slices 29 are disposed all about the display face 16 or baseplate 21, but the micro-pillars 18 are formed only at the sites of the adhesion dots 26. The fibers 18 which contact the adhesion dots 26, remain on the face or baseplate 16, 21. The remaining fibers 18 are removed by subsequent processing. FIG. 5 shows the manner in which the tiles 29 are placed in contact with the predetermined adhesion sites 26 on the black matrix region 25 of the faceplate 16 or in a location corresponding to the black matrix along the baseplate 21. The display face 16 or baseplate 21 with slices 29 disposed thereon is forced against its complementary display surface to enhance adhesion and perpendicular arrangement of the fibers 18 to the face 16 or baseplate 21.

Figure 6A:
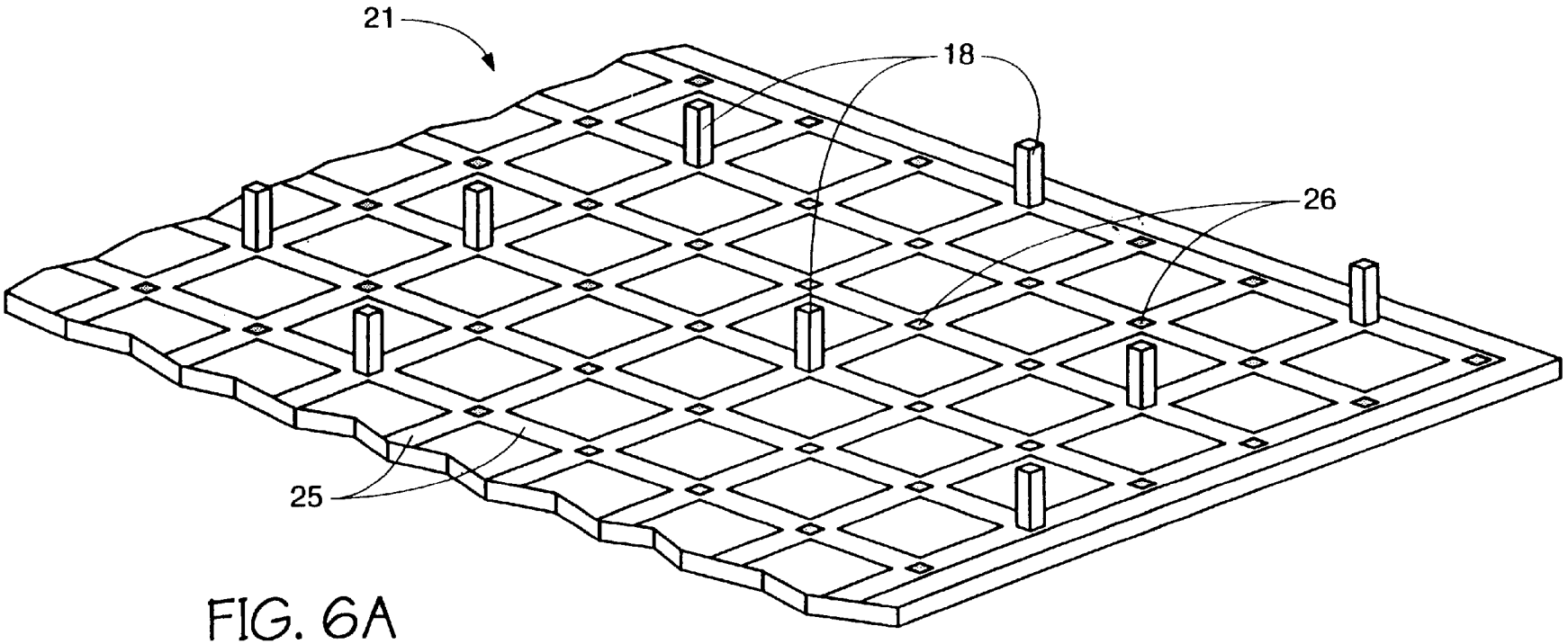
FIGS. 6A–C are schematic cross-sections of a spacer support structure, fabricated according to the process of the present invention.

The glass fibers 18, which do not contact an adhesion site 26, are physically dislodged when the binder or etchable glass strands between the glass fibers 18 are dissolved, thereby leaving a distribution of contiguous high aspect ratio micro-pillars 18. Since the glasses are chosen for selective etchability, the etchable strands of glass are removed by applying acid, for example, hydrochloric acid or aqueous hydrofluoric acid. This results in glass fibers 18 in predetermined locations that protrude substantially perpendicular from the display face 16 or baseplate 21, as shown in FIGS. 6A–C.

Figure 6B:
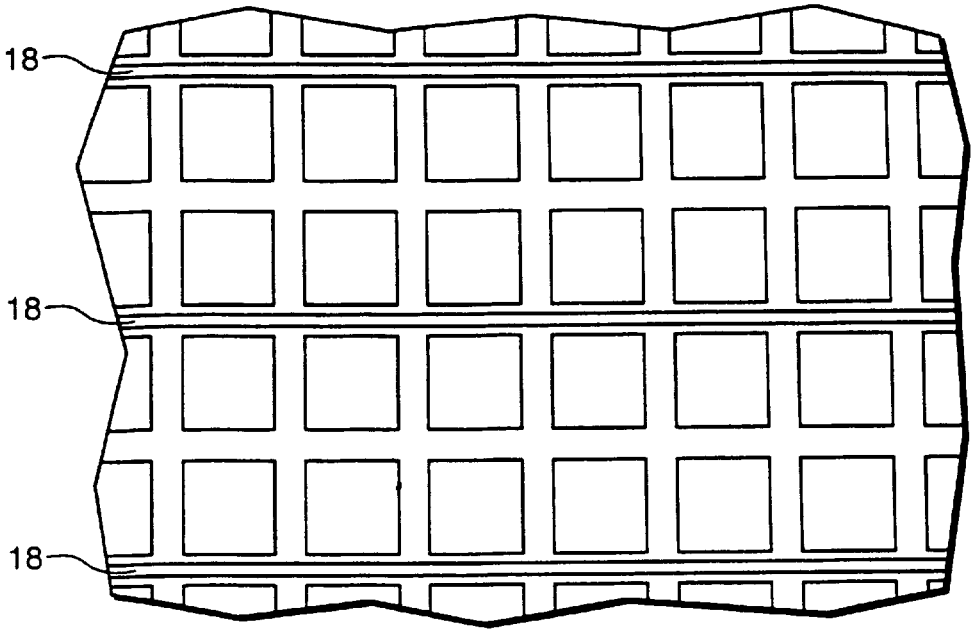
Figure 6C:
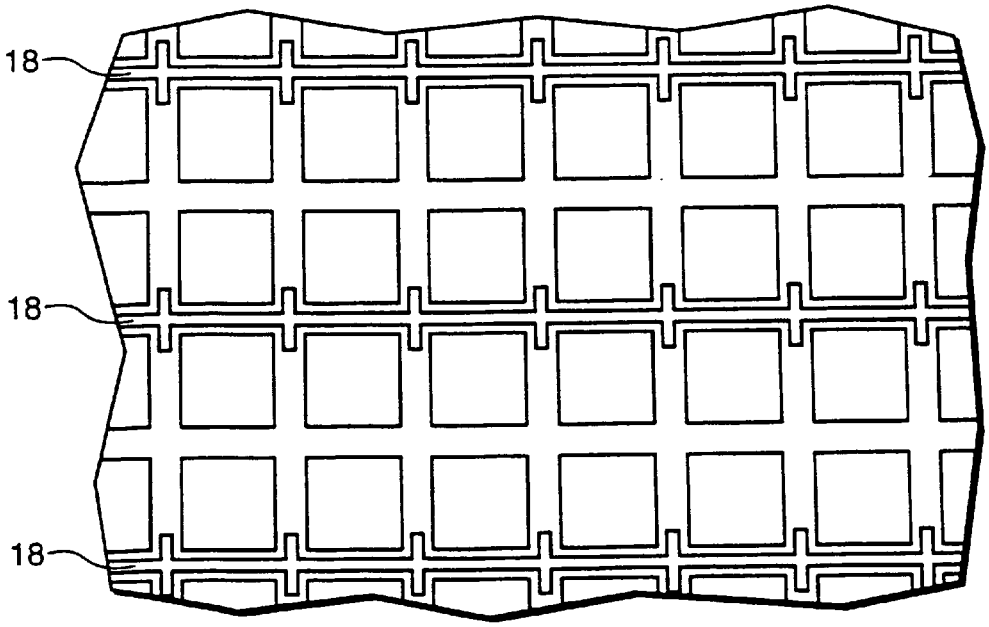

The selective placement and adhesion of contiguous glass fibers 18, according to the preferred embodiment of the invention, results in a rail structure or I-beam structure, as illustrated in FIGS. 6B and 6C, respectively. The thickness of the slice, FIG. 2C, will determine whether the cross-section of the rails, etc, is rectangular or square. The rail or I-beam support structures can be either continuous or discontinuous depending upon the pattern of the glass fibers in the boule 28.

As the spacer support structure is formed from glass fibers arranged contiguously, a pattern is formed by placing an etchable strand 18A proximate a non-etchable strand 18B, as shown in FIG. 2A. When the tile 29 is exposed to an etchant, the etchable strands 18B are removed, thereby producing a discontinuity in the line of contiguous fibers 18A. Hence, a pattern is created using contiguous fibers separated by discontinuities or spaces which result from the removal of the etchable fibers.

In addition to the discontinuities which may result from the selected pattern (e.g., a cross or T-shaped structure), there may be slight discontinuities as a result of the manufacturing process. In such a case, the discontinuity, or break in the line of contiguous fibers, results not from intentional patterning, but rather from a fiber dislodging occurrence in the manufacturing environment.

Since the bending moment of the spacer is dependent on the cross-sectional area, the process of the present invention allows for an increase in the lateral dimension, without a corresponding increase in total surface area.

While the particular process, as herein shown and disclosed in detail, is fully capable of obtaining the objects and advantages herein before stated, it is to be understood that it is merely illustrative of embodiments of the invention, and that no limitations are intended to the details of the construction or the design herein shown, other than as described in the appended claims.

One having ordinary skill in the art will realize that, even though a field emission display was used as an illustrative example, the process is equally applicable to other vacuum displays (such as gas discharge (plasma) and flat vacuum fluorescent displays), and other devices requiring physical supports in an evacuated cavity.

What is claimed is:

1. A method for fabricating a spacer support structure useful in flat panel displays, comprised of the following steps:

forming glass fibers each of said glass fibers having a rectangular cross-section, wherein a first group of said fibers is selectively etchable with respect to a second group of said fibers, and at least two of said glass fibers in said second group of fibers are contiguous.

2. The method for fabricating a spacer support structure according to claim 1, further comprising:

arranging said first and said second groups of glass fibers to form a unit cell;

arranging a plurality of unit cells into a boule;

slicing said boule into slices;

disposing said slices on a display face;

adhering said second group of fibers to said display face; and selectively removing said first group of glass fibers, said second group of fibers forming said spacer support structure.

3. The method for fabricating a spacer support structure according to claim 2, wherein said boule has a rectangular cross-section, said slices having sides.

4. The method for fabricating a spacer support structure according to claim 3, further comprising:

aligning said sides of said slices against one another on said display face prior to removing said first group of glass fibers.

5. The method for fabricating a spacer support structure according to claim 2, further comprising:

aligning said slices on said display face such that said second group of glass fibers are arranged in a row.

6. The method for fabricating a spacer support structure according to claim 2, further comprises:

decreasing the cross-section of said boule prior to said slicing.

7. The method for fabricating a spacer support structure according to claim 3, wherein said rectangular cross-section is a square cross-section.

8. An evacuated display device comprising:

a baseplate;

a faceplate located opposite said baseplate and in parallel relation thereto; and p1 a series of glass rails disposed between and connecting said baseplate and said faceplate, said series of glass rails disposed in parallel relation to said baseplate and said faceplate wherein said series of glass rails is comprised of potash rubidium lead.

9. The evacuated display device of claim 8, further comprising pixels arranged in rows and columns, said series of glass rails being disposed between said pixels.

10. The evacuated display device of claim 9, wherein said series of glass rails is discontinuous.

11. The evacuated display device of claim 8, further comprising a black matrix disposed on said faceplate, said series of glass rails being disposed in said black matrix.

12. The evacuated display device of claim 8, wherein said series of glass rails has cross-pieces disposed at substantially right angles thereto.

13. The evacuated display device of claim 8, wherein said series of glass rails has a high resistance coating.

14. A spacer support structure useful in an evacuated display device, comprising:

a plurality of contiguous and parallel glass fibers arranged as a rail, the widths of said contiguous glass fibers comprising the length of said rail.

15. The spacer support structure of claim 14, wherein said rails have a rectangular cross-section.

16. The spacer support structure of claim 14, wherein said rails have a square cross-section.

17. The spacer support structure of claim 14, wherein said rails are discontinuous.

18. The spacer support structure of claim 14 wherein said rails have cross pieces.

19. A process for manufacturing a field emission display, comprising:

forming a baseplate comprising a plurality of micro-cathodes;

forming a faceplate having phosphors disposed thereon;

arranging a plurality of tiles on said baseplate, said tiles comprising etchable and non-etchable glass micro-fibers, said tiles having a rectangular cross-section; and selectively removing said etchable glass micro-fibers to form support structures.

20. The process for manufacturing a field emission display according to claim 19, wherein said tiles have a substantially square cross-section.

21. The process for manufacturing a field emission display according to claim 19, wherein said tiles are arranged contiguously.

22. The process for manufacturing a field emission display according to claim 19, further comprising:

evacuating said field emission display.

23. The process for manufacturing a field emission display according to claim 19, wherein said non-etchable glass micro-fibers comprise potash rubidium lead.

24. The process for manufacturing a field emission display according to claim 19, wherein said non-etchable glass micro-fibers are substantially contiguous.

25. The process for manufacturing a field emission display according to claim 24, wherein said glass micro-fibers are arranged as I-beams.

26. A method for arranging glass micro-fibers, comprising:

shaping glass fibers into strands having a first rectangular cross-section;

stacking said strands to form a unit cell, said unit cell having another rectangular cross-section;

arranging a plurality of said unit cells into a boule of said glass fibers, said boule of said glass fibers having a boule length and a boule cross-section;

drawing said boule of said glass fibers to decrease said boule cross-section and to increase said boule length;

slicing said boule of said glass fibers parallel to said boule cross-section to form tiles of said glass fibers; and placing said tiles of glass fibers contiguously about a substrate.

27. The method for arranging glass micro-fibers according to claim 26, wherein said glass fibers comprise a first group and a second group, said first group being selectively etchable with respect to said second group.

28. The method for arranging glass micro-fibers according to claim 27, wherein said strands of said unit cells are arranged in a pattern.

29. The method for arranging glass micro-fibers according to claim 28, wherein said unit cells are arranged in another pattern.

30. The method for arranging glass micro-fibers according to claim 29, wherein said tiles are arranged in a further pattern.

31. The method for arranging glass micro-fibers according to claim 30, wherein said second group of said glass fibers forms a shape.

32. The method for arranging glass micro-fibers according to claim 31, wherein said shape comprises at least one of a rail, an I-beam, and a cross.

* * * * *

UNITED STATES PATENT AND TRADEMARK OFFICE

CERTIFICATE OF CORRECTION

PATENT NO. : 6,155,900 
DATED : December 5, 2000
INVENTOR(S) : James J. Hofmann and Jason B. Elledge It is certified that error appears in the above-identified patent and that said Letters Patent is hereby corrected as shown below:

Column 3,
Line 44, after “25” insert -- (FIG. 4) --
Line 45, change “grid” to -- gate --
Line 49, after “screen” and before “16” insert -- or faceplate --
Line 57, change “spacers 18” to -- spacer support structures 18 --

Column 4,
Line 7, change “strands 18” to -- spacer support structures 18 --
Line 15, change “the substrate” to -- a substrate --
Lines 17 and 21, change “fibers 18” to -- spacer support structures 18 --
Line 20, change “over” to -- thereover --
Line 31, delete “18”
Lines 32 and 33, after “strands” insert -- or fibers --
Lines 35, 36 and 37, before “fibers” insert -- glass strands or --
Line 36, change “bundle” to -- mixed glass assembly --
Line 43, before “fibers” insert -- non-etchable glass strands or --
Line 44, before “glass” insert -- mixed --
Line 46, after “fiber” delete “or”
Lines 46, 48, 51, 54 and 55, change “28” to -- 28’ --
Line 62, change “18” to -- 18A --
Line 64, change “multi-fiber 28” to -- single-fiber unit cell 28’ --

Column 5,
Line 2, change “28” to -- 28’ --
Line 19, after “fibers” insert -- 18A, 18B --
Lines 20, 21 and 64, change “18” to -- 18A, 18B --
Line 20, change “bundle” to -- mixed glass assembly --
Line 23, change “glass strands 18” to -- fibers 18A, 18B --
Line 25, change “bundles 28” to -- single-fiber unit cells or bundles 28’ --
Line 37, change “spacers 18” to -- spacer support structures 18 --
Lines 42 and 55, change “adhesion” to -- adhesive --
Line 45, change “emitter” to -- cathode --
Line 46, before “sites” insert -- black matrix -- and change “support pillars” to -- spacer support structures 18 --
Lines 49 and 50, after “the” and before “micro-pillars” insert -- spacer support structures or --
Line 51, change “fibers” to -- spacer support structures -- and change “adhesion” to -- adhesive --
Lines 52 and 61, before “face” insert -- display --

UNITED STATES PATENT AND TRADEMARK OFFICE

CERTIFICATE OF CORRECTION

PATENT NO. : 6,155,900 
DATED : December 5, 2000
INVENTOR(S) : James J. Hofmann and Jason B. Elledge It is certified that error appears in the above-identified patent and that said Letters Patent is hereby corrected as shown below:

Column 5 (cont'd),
Lines 52 and 60, change "fibers" to -- spacer support structures --
Line 57, after "matrix" insert -- region 25 --
Line 62, change "18" to -- 18A, 18B -- and change "adhesion sites" to -- adhesive dots --
Line 66, change "micro-pillars" to -- spacer support structures -- and change "glasses" to -- fibers 18A, 18B --

Column 6,
Line 1, after "glass" insert -- fibers 18B --
Lines 3 and 8, change "fibers" to -- spacer support structures --
Line 15, change "boule 28" to -- boule 38 --
Line 16, after "structure" insert -- 18 -- and after "fibers" insert -- 18A, 18B --
Lines 17-18, change "an etchable strand 18a proximate a non-etchable strand" to -- a non-etchable strand or fiber 18A proximate an etchable strand or fiber --
Line 20, change "strands 18B" to -- glass strands or fibers 18B --
Line 21, change "18A" to -- 18A, 18B --
Lines 22 and 24, after "fibers" insert -- 18A, 18B --
Lines 54-55 and 56, after "said" and before "fibers" insert -- glass --
Line 57 and 65, before "fibers" insert -- glass --

Column 7,
Line 2, before "fibers" insert -- glass --
Line 26, delete "p1"

Signed and Sealed this

Tenth Day of February, 2004

JON W. DUDAS
*Acting Director of the United States Patent and Trademark Office*